US010218080B2

(12) United States Patent
Polehn et al.

(10) Patent No.: US 10,218,080 B2
(45) Date of Patent: Feb. 26, 2019

(54) PASSIVE METAMATERIAL HETERODYNING ANTENNA

(71) Applicant: Verizon Patent and Licensing Inc., Basking Ridge, NJ (US)

(72) Inventors: Donna L. Polehn, Kirkland, WA (US); Fred Weisbrod, Renton, WA (US); Corey J. Christopherson, Issaquah, WA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 133 days.

(21) Appl. No.: 15/265,518

(22) Filed: Sep. 14, 2016

(65) Prior Publication Data

US 2018/0076531 A1 Mar. 15, 2018

(51) Int. Cl.

| | |
|---|---|
| ***H01Q 3/46*** | (2006.01) |
| ***H01Q 15/00*** | (2006.01) |
| ***H01Q 1/24*** | (2006.01) |
| ***H01Q 3/26*** | (2006.01) |
| ***H01Q 1/38*** | (2006.01) |

(52) U.S. Cl.

CPC ..... *H01Q 15/0086* (2013.01); *H01Q 1/24* (2013.01); *H01Q 1/241* (2013.01); *H01Q 1/38* (2013.01); *H01Q 3/2676* (2013.01); *H01Q 3/46* (2013.01)

(58) Field of Classification Search

CPC .... H01Q 15/0086; H01Q 3/46; H01Q 3/2676; H01Q 1/38; H01Q 1/241

USPC ..... 343/904, 753, 702, 754

See application file for complete search history.

(56) References Cited

U.S. PATENT DOCUMENTS

| | | | | |
|---|---|---|---|---|
| 2008/0258981 | A1* | 10/2008 | Achour | H01Q 21/065 343/702 |
| 2011/0210903 | A1* | 9/2011 | Sarabandi | H01Q 15/0086 343/904 |
| 2016/0211578 | A1* | 7/2016 | Ghelfi | H01Q 3/2676 |

* cited by examiner

*Primary Examiner* — Jessica Han
*Assistant Examiner* — Hai Tran

(57) ABSTRACT

A wireless signal at a low frequency is received at a face of a meta-material antenna. An offset carrier, at a high frequency, is received at an opposite direction face of the metal-material antenna. Passive mixers upshift the low frequency wireless signal to a high frequency, at the difference between the low frequency and the offset carrier. The upshifted version of the received low frequency signal is radiated from a second face of the meta-material antenna.

20 Claims, 6 Drawing Sheets

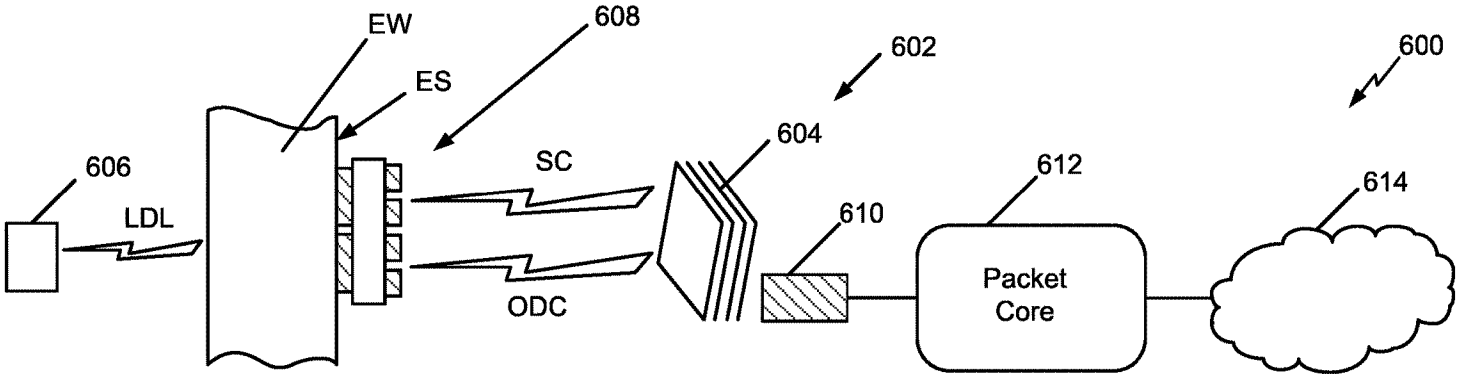
FIG. 6
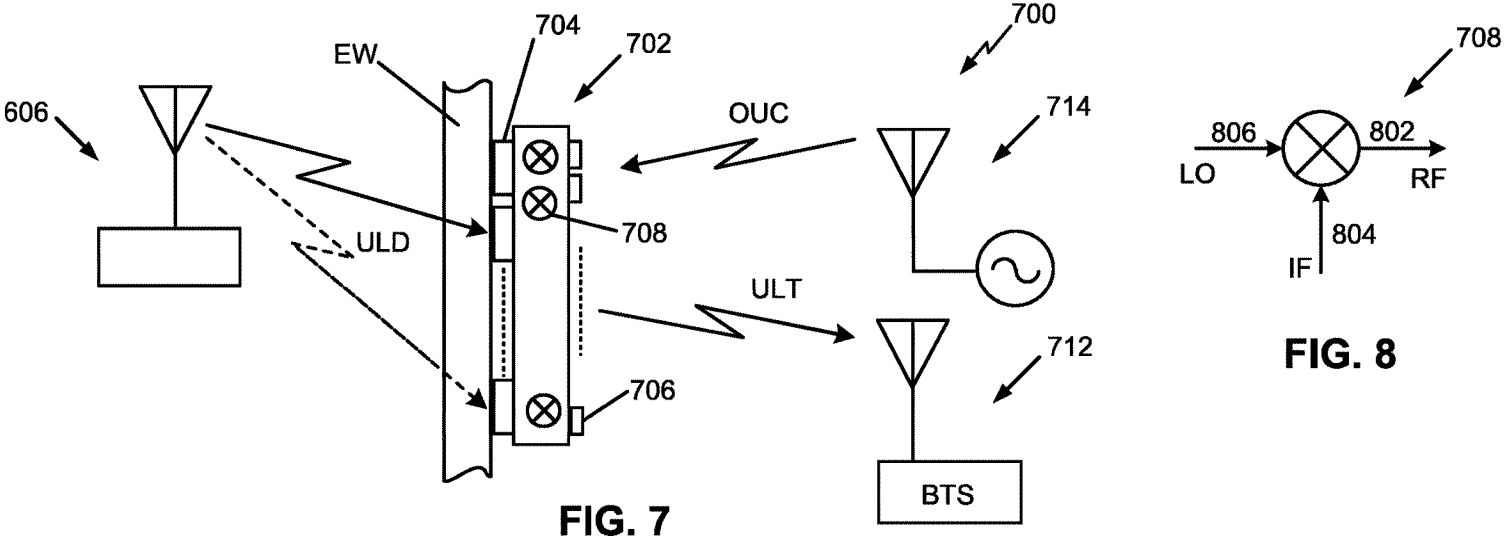
FIG. 8
FIG. 7

PASSIVE METAMATERIAL HETERODYNING ANTENNA

BACKGROUND

There is available spectrum in the millimeter wave region. However, signal propagation characteristics particular to that region can present technical difficulties that may add costs to, or otherwise hinder its exploitation for certain communications. For example, users of present 3G and 4G cellular telephone devices can generally enter homes and other buildings without intolerable interruption of service. One reason is that 3G and 4G can operate at ultrahigh frequencies (UHF) that can propagate through most wall structures without unacceptable attenuation. Millimeter wave frequencies, in contrast, can be extremely directional and generally have a very limited building penetration.

These propagation characteristics of millimeter waves have been long known as potential problems that, for at least some applications, can render millimeter wave communication impractical in terms of cost and performance. Known techniques directed to solving or reducing such problems can have significant costs and shortcomings. For example, coding bits can be added to compensate for error rates arising from attenuation by buildings and other structures. However, for some applications, the necessary amount of coding bits can be unacceptably large.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 6 illustrates one system, overlaid with diagrammed examples of downlink operations of same, utilizing a heterodyning meta-material antenna according to various aspects.

FIG. 7 illustrates one system, overlaid with diagrammed examples of uplink operations of same, utilizing a passive mixing/heterodyning meta-material antenna according to various aspects.

FIG. 8 illustrates one example mixer topology, for a passive mixer heterodyning meta-material antenna according to various aspects.

DETAILED DESCRIPTION

Figure 1A:
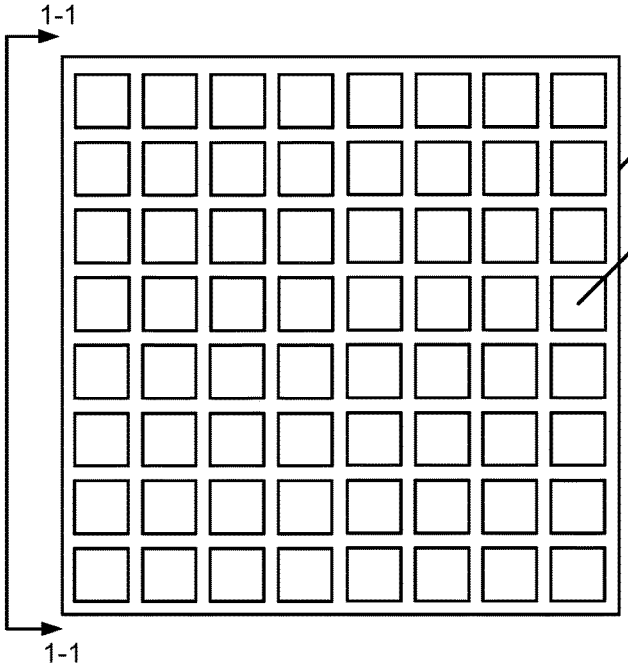
FIG. 1A illustrates a front projection of a portion of one example passive heterodyning meta-material antenna, showing exemplary high frequency array elements according to one implementation.

In the following detailed description, numerous specific details are set forth by way of examples in order to provide a thorough understanding of the disclosed subject matter. It will be apparent to persons of ordinary skill, upon reading this description, that various aspects can be practiced without such details.

In one implementation, an example passive heterodyning meta-material antenna according to disclosed aspects can include a first substrate and a second substrate spaced apart by a fill region. The first substrate and second substrate can have respective inner surfaces facing one another, spaced apart by the fill region, and can have respective outer surfaces, facing in opposite directions away from the fill region. An array of first conducting elements can be supported on the outer surface of the first substrate. An array of second conducting elements can be supported on the outer surface of the second substrate. The array of first conducting elements can have a substantially superposed alignment with the array of second conducting elements. The array of first conductive elements can be configured according to a first pattern. The first pattern can include, but is not limited to, a length and a width of the first conductive elements; spacing between adjacent first conductive elements, a population count of the first conductive elements and a distribution pattern of the first conductive elements. The array of second conductive elements can be configured according to a second pattern. The second pattern can include, but is not limited to, a length and a width of the second conductive elements; spacing between adjacent second conductive elements, a population count of the second conductive elements and a distribution pattern of the second conductive elements.

In an implementation, an array of bandpass filter devices can be disposed in the fill region, each of the bandpass filter devices including planar conductors. The planar conductors can be aligned parallel to a common plane approximately normal to a plane of the first and second conductive elements. In an aspect, the bandpass filter devices and their respective planar conductors can be arranged in an array, according to a third pattern.

According to an implementation, given a thickness of the first substrate, the first pattern and the third pattern can be configured, in combination with one another, to provide a meta-material characteristic for signals incident on the first array of conductive elements that are within a first frequency band. For purposes of description, the first frequency band will be alternatively referred to as the "upper frequency band meta-material characteristic for signals that are within the first frequency band and are incident on the first array of conductive elements will be alternatively referred to as an "upper frequency meta-material characteristic." The upper frequency meta-material characteristic can include a negative refractive index, provided by a negative permeability, a negative permittivity, or both. The frequency band over which the passive heterodyning meta-material antenna provides its upper frequency meta-material characteristic can be alternatively referred to as the "upper frequency meta-material band." It will be understood that "upper frequency meta-material characteristic" and "upper frequency meta-material band" are arbitrary labels, applied herein for convenience in describing examples, and do not import or otherwise add any limitation to this disclosure.

Implementations of a passive heterodyning meta-material antenna according to disclosed aspects can include each of the bandpass filter devices having at least one input port and at least one output port. In an implementation, the bandpass filters can be configured with an upper cut-off frequency. Considerations in choosing the upper cut-off frequency are described in greater detail later. It will be understood that "port," as used herein, encompasses, but is not limited to structures within the commonly understood meanings, to persons of ordinary skill in the arts pertaining to this disclosure, of port, terminal, connection, path, coupling, and equivalents thereof. In an aspect, the input port can be proximal the inner surface of the first substrate and the output port can be proximal the inner surface of the second substrate. In an implementation, a first conductive element can extend through the first substrate and couple each first conductive element to the input port of a corresponding one of the bandpass filter devices. Also, in an implementation, each second conductive element can be fed by outputs of a plurality of the bandpass filter devices. For example, each second conductive element can connect to a respective plurality of second conductive elements, each extending through the second substrate and coupling to the output port of one of the bandpass filter devices.

According to various implementations, the second pattern and the third pattern can be configured, in combination, to provide a meta-material characteristic for transmitting (and receiving) a given frequency or band of frequencies from the second conductive elements. The given frequency or band of frequencies is within the passband of the bandpass filter devices. The meta-material characteristic provided by the second pattern and the third pattern can be referred to, for purposes of description, as a "lower frequency meta-material characteristic." The lower frequency meta-material characteristic can include a negative refractive index, provided by a negative permeability, a negative permittivity, or both. The frequency band over which the passive heterodyning meta-material antenna provides its lower frequency meta-material characteristic can also be referred to as the "lower frequency meta-material band." It will be understood that "lower frequency meta-material characteristic" and "lower frequency meta-material band" are arbitrary labels, applied herein for convenience in describing examples, and do not import or otherwise add any limitation to this disclosure.

As will be described in greater later, in one example system a passive heterodyning meta-material antenna can be mounted on, for example, an exterior wall of a building, with its lower frequency array facing the exterior wall surface, and its higher frequency array facing in an opposite direction, away from the building. An end user wireless device, configured to receive a downlink at FL can be within the building. A transmitter, for example a base transceiver station (BTS), can transmit a downlink signal SD at a frequency FD, with a directivity and power sufficient to reach the higher frequency array. FD can be far higher than FL, for example, in the millimeter band, which can be severely attenuated by exterior (and by interior) walls of buildings. In an implementation, the BTS can also transmit, concurrent with the downlink SD, an offset carrier SF at a frequency FS that is spaced from FD by FL, the downlink reception frequency of the end user wireless device. The passive heterodyning meta-material antenna can be configured such that FD and FS are in the upper frequency meta-material band, and FL is in the upper frequency meta-material band. Since FD and FS are in the higher frequency meta-material band, energy of SD and SF can efficiently couple to the higher frequency array, and then to the inputs of the low frequency filter devices. The sum of SD and SF can produce a frequency downshifted version of SD, positioned in frequency at the difference of FD and FS, which is FL, the downlink frequency of the user wireless device. Since FL is within the lower frequency meta-material band of the passive heterodyning meta-material antenna, the frequency downshifted version of SD can be efficiently transmitted through the exterior wall and reach the user wireless device.

The above-described example operations of the passive heterodyning meta-material antenna therefore, using only the energy of the received SD and SF, effectively "down convert" the SD high frequency downlink signal to a much lower FL frequency that can pass through the exterior walls of a building and can reach, for example, conventional receiver devices having an FL downlink frequency.

For purposes of illustration, contemplated implementations can provide passive heterodyning downshifting of downlink signals at frequencies over ranges encompassing, but not limited to, approximately 20 GHz to approximately 100 GHz, to lower frequencies in ranges encompassing, but not limited to, approximately 400 MHz to 1 GHz. It will be understood that 20 GHz, 100 GHz, 400 MHz and 1 GHz are only examples, and are not intended to limit the scope of implementations, and not intended as preferred frequencies.

One example implementation of a passive heterodyning meta-material antenna as described above will now be described in reference to FIGS. 1A-1D. The example will be referenced as the "passive heterodyning meta-material antenna" 100. FIG. 1A shows a front projection of the passive heterodyning meta-material antenna 100. Referring to FIG. 1A, structure can include an array of first conductive patches 102, supported on an outer surface (visible in FIG. 1A but not separately numbered) of a first substrate 104. The first conductive patches 102 can be an example implementation of the higher frequency array elements described above. For purposes of description, first conductive patches 102 will be alternatively referenced, collectively, as the "high frequency array 102."

Figure 1B:
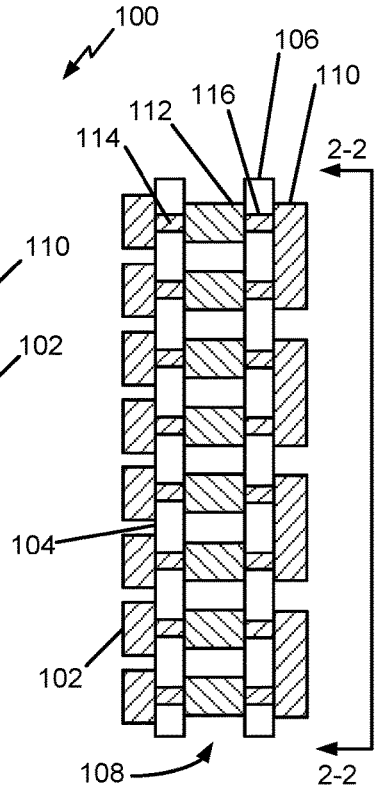
FIG. 1B illustrates a portion of the FIG. 1A passive heterodyning meta-material antenna, seen from the FIG. 1A cross-cut projection 1-1, showing a portion of one arrangement of bandpass filter devices according to one implementation.

FIG. 1B illustrates a portion of the passive heterodyning meta-material antenna 100, as viewed from the FIG. 1A cross-cut projection 1-1. Referring to FIG. 1B, passive heterodyning meta-material antenna 100 can include a second substrate 106, having an inner surface (visible but not separately labeled) that faces and is spaced by a fill region 108 from an inner surface (visible but not separately labeled) of the first substrate 104. In one implementation, the first substrate 104 and the second substrate 106 can be formed, for example, of printed circuit board (PCB) material. It will be understood that PCB is only one example, and is not intended as a limitation or a preference as to materials for the first substrate 104 and second substrate 106.

Figure 1C:
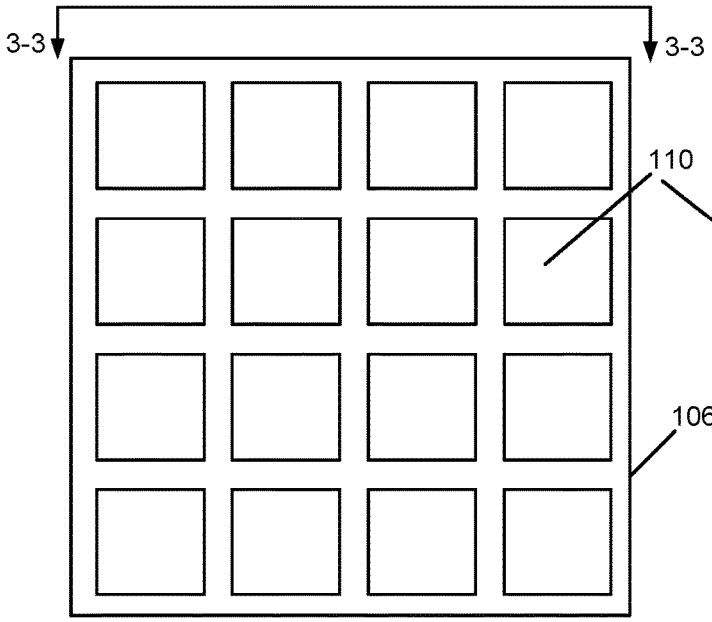
FIG. 1C illustrates a portion of the FIG. 1A passive heterodyning meta-material antenna, seen from the FIG. 1A cross-cut projection 2-2, showing a portion of one arrangement of bandpass filter devices according to one implementation.

FIG. 1C illustrates another portion of the passive heterodyning meta-material antenna 100, as viewed from the FIG. 1B back projection 2-2. Referring to FIGS. 1B and 1C, an outer surface (visible but not separately labeled) of the second substrate 106 can support an array of second conductive patches 110 (visible in part in FIG. 1B). The second conductive patches 110 can be an example implementation of the lower frequency array elements described above. For purposes of description, the second conductive patches 110 will be alternatively referenced, collectively, as the "low frequency array 110."

Referring to FIG. 1B, the passive heterodyning meta-material antenna 100 can include an arrangement of bandpass filters 112, portions of which are visible in the figure. The bandpass filters 112 can be an implementation of the bandpass filter devices described above. In an aspect, the bandpass filters 112 can be formed of planar conductors (not explicitly visible in FIG. 1B), supported on respective substrates aligned parallel to the image plane of FIG. 1B. Examples will be described in greater detail in reference to FIGS. 2A, 2B, 4A, and 4B. Regarding the extending plane of the planar conductors of the bandpass filters 112, in one implementation, all can be parallel to the image plane of FIG. 1B, and normal to the image plane of FIG. 1D, as can be seen in these figures.

In an implementation, the first conductive patches 102 can be arranged and configured according to what can be termed a "higher frequency array pattern." The higher frequency array pattern can correspond to the "first pattern" described above. The bandpass filters 112, and their respective planar conductors, can be arranged according to the above-described "second pattern." In one example, the higher frequency array pattern and second pattern can be selected to provide the passive heterodyning meta-material antenna 100 an upper frequency meta-material band that includes a given range of high frequency downlink signal frequencies, for example, a band or sub-band within the example ranges described above. Similarly, the second conductive patches 110 can be arranged and configured according to what can be termed a "lower frequency array pattern." The lower frequency array pattern can correspond to the "third pattern" described above. In an implementation, the lower frequency array pattern can be selected such that, in combination with the second pattern, the passive heterodyning meta-material antenna 100 is provided a lower frequency meta-material band that includes a given range of lower frequency downlink signal frequencies.

Example operations of the bandpass filters 112 will be first described in reference to downlink frequency shifting. In such operations, the bandpass filters 112 allow a downshifted version of a high frequency downlink signal, centered at the downlink frequency of an end user wireless device, to pass from the high frequency array 102 to the low frequency array 110, for transmission to that user device. Another implementation of the passive heterodyning meta-material antenna 100, described in greater detail in reference to FIGS. 7-10, can receive a low frequency uplink signal from the end user device, and receive an offset uplink carrier from the BTS, and perform a passive mixing heterodyning that frequency upshifts the low frequency uplink to a much higher BTS uplink frequency, and can then transmit (where "transmit" can be a passive re-radiation) the upshifted uplink to the BTS. Such implementations can be additional features added to the passive heterodyning meta-material antenna 100, or can be formed as a separate device, as will be described in greater detail later. Implementations having the uplink passive upshifting feature in addition to the downlink passive downshifting feature will be referred to "uplink/downlink passive heterodyning meta-material antenna."

Implementations of the uplink/downlink passive heterodyning meta-material antenna can use bi-directional bandpass filters 112. In operations of downlink passive downshifting, the bi-directional bandpass filters 112 can carry a downshifted version of the downlink signal, from high frequency array 102 to the low frequency array 110. In operations of uplink passive upshifting, the bi-directional bandpass filters 112 can carry a low frequency uplink signal from the low frequency array 110 to passive mixer circuitry, as will be described. Therefore, it will be understood that the port or connection of the bandpass filters 112 described, in the context of downlink passive downshifting, as functioning as the input of bandpass filters 112 can be identical to the port or connection of the bandpass filters 112 described, in the context of uplink passive upshifting, as functioning as the output of bandpass filters 112. Accordingly, that port of the bandpass filters 112, in the context of downlink passive downshifting, will be referred to as the "downlink input port" and, in the context of uplink passive upshifting, will be referred to as the "uplink output port." Likewise, it will be understood that the port or connection of the bandpass filters 112 described, in the context uplink passive upshifting, as the "input of bandpass filters" 112, can be identical to the port or connection of the bandpass filters 112 described, in the context downlink passive downshifting, as the "output of bandpass filters" 112. Accordingly, that port of the bandpass filters 112, in the context of downlink passive downshifting, will be referred to as the "downlink output port" and, in the context of uplink passive upshifting, will be referred to as the "uplink input port."

Referring to FIG. 1B, the downlink input port of each bandpass filter 112 can be coupled to a corresponding one of the first conductive patches 102. For each bandpass filter 112, its downlink output port and the downlink output port of at least one other bandpass filter 112 can couple to the same one of the second conductive patches 110. In other words, second conductive patches 110 can each be fed by the downlink output port of two or more bandpass filters 112. Couplings to the downlink input ports of the bandpass filters 112 can include first conducting members 114, each extending through the first substrate 104. Similarly, couplings to the downlink output ports of the bandpass filters 112 can include second conducting members 116, each extending through the second substrate 106. Example implementations of the first conducting members 114 and second conducting members 116 can include, but are not limited to, conductive through-vias, and any of various alternative conventional means for conductive paths through a substrate.

Referring to FIG. 1A, the array of first conductive patches 102, i.e., the high frequency array 102, can be arranged in a Cartesian tile pattern, for example, as an 8×8 row-by-column array. Referring to FIG. 1C, the array of second conductive patches 110, i.e., the low frequency array 110, can also be arranged in a Cartesian tile pattern, for example, as a 4×4 row-by-column array. It will be understood that the specific arrangements can be based, in part, on the given range of downlink high frequencies to be received at the higher frequency array, and the given range of lower frequency downshifted downlinks to be transmitted from the lower frequency array. It will be understood row-by-column dimensions of 8×8 and 4×4 are only examples, and that in implementations using a Cartesian pattern, the high frequency array 102 can be any M×N row-by-column arrangement, and the low frequency array 110 can be any R×S row-by-column arrangement, with M, N, R, and S being integers. It will also be understood that the Cartesian tile pattern is only for purposes of example, as various alternative layout patterns or arrangements can be employed for the first conductive patches 102, or the second conductive patches 110, or both. In addition, it will also be understood that the generally square perimeter of the first conductive patches 102 and of the second conductive patches 110 are only for purposes of example; various alternative perimeter shapes can also be employed.

Figure 1D:
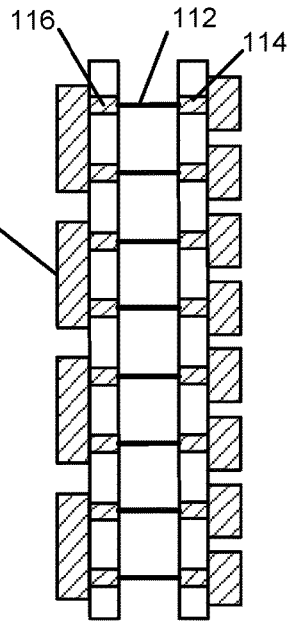
FIG. 1D illustrates another portion of the FIG. 1A passive heterodyning meta-material antenna, from the FIG. 1B back projection 3-3, showing exemplary low frequency array elements, according to one implementation.
Figure 2A:
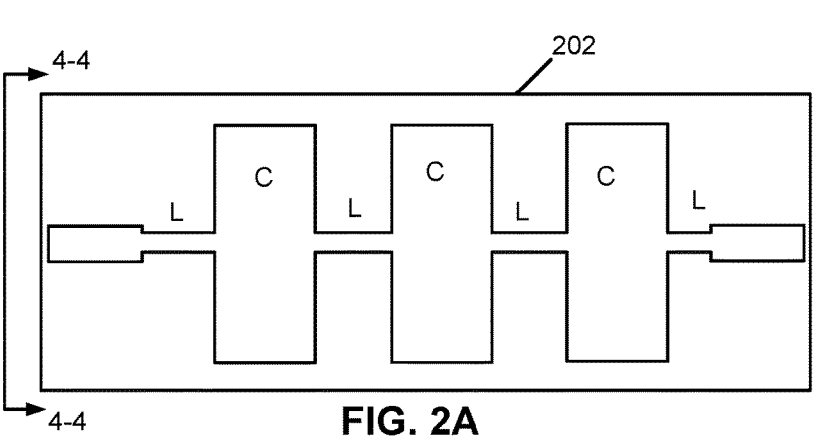
FIG. 2A illustrates, on a projection parallel the plane of FIG. 1B, one example bandpass filter structure for the FIGS. 1A-1D passive heterodyning meta-material antenna.
Figure 2B:
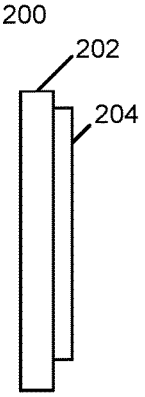
FIG. 2B illustrates the FIG. 2A bandpass filter structure, viewed, on a projection parallel the image plane of FIG. 1D.

FIG. 2A illustrates, on a projection parallel the plane of FIG. 1B, one example bandpass filter structure for the FIGS. 1A-1D passive heterodyning meta-material antenna, which will be referred to as "bandpass filter 200." FIG. 2B illustrates the bandpass filter 200, viewed on a projection parallel the image plane of FIG. 1D. Referring to FIGS. 2A and 2B, the bandpass filter 200 can be formed of a metallization 202 supported on a filter groundplane/substrate 204. The metallization 202 can be formed as a series connection of capacitor patches, generically labeled as "C," connected by inductive traces generically labeled as "L." It will be understood that the different instances of "C" do not necessarily represent mutually identical capacitance values. It will likewise be understood that the different instances of "L" do not necessarily represent mutually identical inductance values. The values of C and L and the corresponding dimensions of the capacitor patches and inductor traces can be based, at least in part, on the desired upper cut-off frequency FH of the bandpass filter 200. Persons of ordinary skill, facing an application with a given FH, can readily select the sizes and configurations for the capacitor plates and inductor traces, without undue experimentation. Accordingly, further detailed description is omitted. It will be understood that the FIG. 2A illustrated configuration for the metallization 202 is only for purposes of example, and is not intended to limit the scope of this disclosure or to convey a preference as to configuration, or as to the population of capacitor plates or the population of inductor traces.

Figure 3:
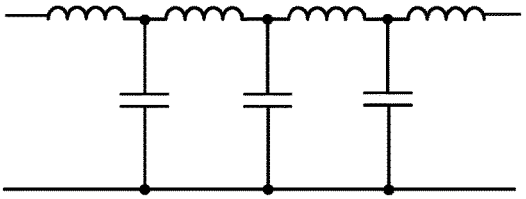
FIG. 3 illustrates a lumped parameter model of the FIGS. 2A-2B bandpass filter structure.

FIG. 3 illustrates a lumped parameter model of the FIGS. 2A-2B bandpass filter structure.

Figure 4A:
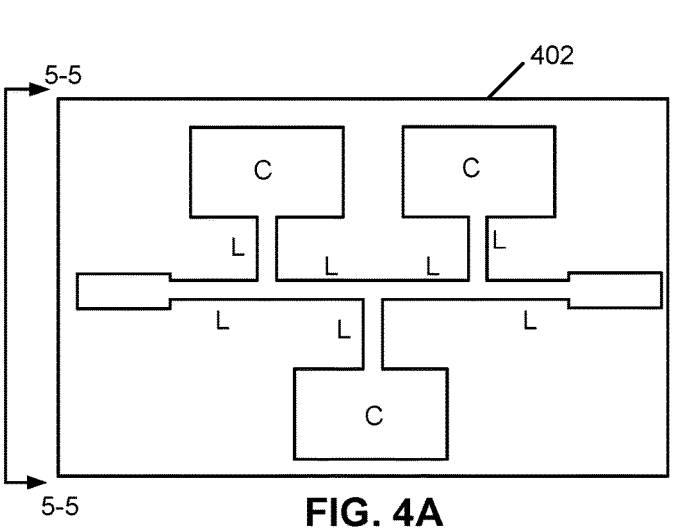
FIG. 4A illustrates, on a projection parallel the plane of FIG. 1B, another example bandpass filter structure for the FIGS. 1A-1D passive heterodyning meta-material antenna.
Figure 4B:
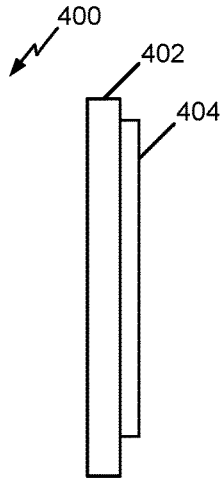
FIG. 4B illustrates the FIG. 4A bandpass filter structure, viewed, on a projection parallel the image plane of FIG. 1D.

FIG. 4A illustrates, on a projection parallel the plane of FIG. 1B, another example bandpass filter structure for the FIGS. 1A-1D passive heterodyning meta-material antenna. FIG. 4B illustrates the FIG. 4A bandpass filter 400, viewed, on a projection parallel the image plane of FIG. 1D. Referring to FIGS. 4A and 4B, the bandpass filter 400 can be formed of a metallization 402, including capacitor patches interconnected by inductor traces as illustrated, supported on a filter groundplane/substrate 404. As with the bandpass filter 200, the dimensions of the capacitor patches and inductor traces of the metallization 402 can be based, at least in part, on the desired upper cut-off frequency FH of the bandpass filter 112 implemented by the bandpass filter 400. Persons of ordinary skill, facing an application with a given FH, can readily select the sizes and configurations for the bandpass filter 400 capacitor plates and inductor traces, without undue experimentation. Accordingly, further detailed description is omitted. It will be understood that the FIG. 4A illustrated configuration for the metallization 402 is only for purposes of another example, and is not intended to limit the scope of this disclosure or to convey a preference as to configuration, or as to the population of capacitor plates or the population of inductor traces.

Figure 5:
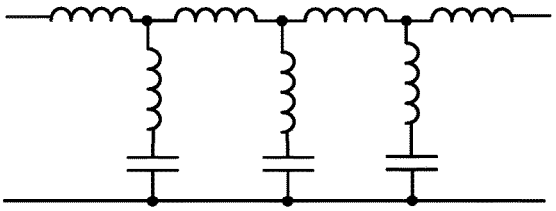
FIG. 5 illustrates one lumped parameter model of the FIGS. 4A-4B example bandpass filter structure.

FIG. 5 illustrates one lumped parameter model of the FIG. 4 example bandpass filter structure FIG. 6 illustrates one passive heterodyning meta-material antenna communication system 600 according to one implementation, annotated to show example downlink communication operations according to various aspects. For brevity, the passive heterodyning meta-material antenna communication system 600 will be alternatively referred to as the "system 600." Referring to FIG. 6, the system 600 can include a base transceiver station (BTS) 602. The BTS 602 can transmit from a BTS transmission antenna 604 an information-carrying downlink signal (labeled "SC"), in a direction and power sufficient for the information to be satisfactorily recovered by a hypothetical receiver (not visible in FIG. 6) tuned to SC and located on an exterior surface ES of an exterior wall EW of a house or other building (visible in part in FIG. 6, but not separately labeled).

The system 600 can also include an end user wireless device 606. The end user wireless device 606 can be in an interior of the house or building, separated from the building exterior by at least the exterior wall EW. The end user wireless device 606 can be, for example, a conventional "set-top" box for a multimedia entertainment center, a "smart phone" or other mobile wireless communication device. The end user wireless device 606 may be configured to receive a standard protocol wireless downlink signal in a region of the UHF (ultrahigh frequency) band. For purposes of describing example operations, it will be assumed that the end user wireless device 606 is configured to receive at approximately 500 MHz, or at another frequency location in the UHF (ultrahigh frequency) band. It will also be assumed that the exterior wall EW and any other wall or structure separating the end user wireless device 606 from the exterior of the building are sufficiently transparent to the receiving frequency (e.g., 500 MHz) of the end user wireless device. It will be understood that 500 MHz is only one example, and is not intended to limit practices according to disclosed aspects, or to convey any preference as to frequency. For purposes of this description, "sufficiently transparent" means that a conventional signal, at the receiving frequency of the end user wireless device 606, received at the exterior ES from a conventional transmission source at a power within a normally acceptable received signal power, would pass through the wall EW and be recoverable by the end user wireless device 606.

Referring to FIG. 6, it will be assumed that SC is at a much higher frequency, to which the wall EW is not transparent. For example, SC can be centered at 28 GHz or at another frequency position within the millimeter wave band. The end user wireless device 606 used for this example, however, is assumed to receive downlink at a frequency of 500 MHz, and therefore is not capable of receiving 28 GHz.

The system 600 can overcome problems such as described above by providing passive downshifting or down converting of SC from 28 GHz to the 500 MHz receiving frequency of the end user wireless device 606. The system 600 can provide such passive down shifting by mounting or securing a passive meta-material heterodyning antenna 608 according to disclosed aspects to the exterior surface ES, combined with transmitting from the BTS 602 an offset downlink carrier, (labeled "ODC") which can be a non-modulated, e.g., pure sine wave carrier, at a frequency spaced from the 28 GHz downlink frequency by a distance equal to the receiving frequency of the end user wireless device 606. In this example, that frequency is 500 MHz and, therefore, ODC will be at 28.5 GHz.

To assist in describing example operations and features of the system 600 that are particular to novel aspects, without having to describe new example structures, it will be assumed that the passive heterodyning meta-material antenna 608 is structured according to the passive heterodyning meta-material antenna 100 described in reference to FIGS. 1A-1D. Also, the following assumptions will apply regarding the "first pattern" configuration and arrangement of the upper frequency elements 102, the "second pattern" arrangement and configuration of the bandpass filter devices 112, the "third pattern" configuration and arrangement of the lower frequency elements 110, and the bandpass filter devices 122; the first pattern and second pattern are such that 28 GHz and 28.5 GHz are within the upper frequency meta-material band of the passive heterodyning meta-material antenna 608; the third pattern and second pattern are such that 500 MHz is within the lower frequency meta-material band of the passive heterodyning meta-material antenna 608, and the upper cut-off FH of the bandpass filter device is approximately 500 MHz.

Referring to FIG. 6, since 28 GHz and 28.5 GHz are within the upper frequency meta-material antenna band, SC and ODC can efficiently energize the first conductive elements (partially visible but not labeled in FIG. 6, visible as items 102 in FIGS. 1A, 1B, and 1D). This will feed the inputs of the bandpass filter devices (not visible in FIG. 6, visible as items 112 in FIGS. 1B and 1D). Signal components at the difference between 28 GHz and 28.5 GHz, i.e., 500 MHz, will pass through the bandpass filter devices and energize the lower frequency conductive elements (partially visible but not labeled in FIG. 6, visible as items 110 in FIGS. 1B, 1C, and 1D). Since 500 MHz is within the lower frequency meta-material band of the passive heterodyning meta-material antenna 608, such frequencies will be broadcast toward the end user wireless device 606. Frequency components at the sum of the SC and ODC frequencies, i.e., 56.5 GHz, and all other frequencies above the upper frequency cut-off of the bandpass filter devices 112 will be blocked.

The combination of the passive heterodyning meta-material antenna 608 being configured as described, and the BTS 602 configured to transmit, along with the 28 GHz SC, the 28.5 GHz ODC operate to down convert or shift the 28 GHz downlink signal SC to a UHF downlink signal, at 500 MHz, that can pass through the bandpass filters of the passive heterodyning meta-material antenna 608 to energize the antenna's low frequency array against the surface ES. The antenna's low frequency array then transmits this 500 MHz UHF downlink as a local downlink (labeled "LDL"), which passes through the wall EW and reaches the wireless end user device 608. The down conversion or shifting from the 28 GHz downlink signal SC to the 500 MHz local downlink LDL does not require power (e.g., conventional power grid power or battery power) to the passive heterodyning meta-material antenna 608. In more general terms, the system 600 can provide frequency shifting of a downlink signal, such as SC, that cannot pass through exterior walls and other common obstructions, to a frequency that can pass through a wall such as exterior wall EW, and reach an end user wireless device within the building—without requiring power and with no need to drill holes through the exterior wall EW.

In one or more implementations, the system 600 can include a BTS controller 610 that can interface, for example through a packet core 612, a wide area network (WAN), such as the Internet 614.

Examples described above utilized the passive meta-material heterodyning antenna 608, in combination with the ODC offset downlink carrier, to shift a downlink signal to a much lower frequency, to pass through exterior walls (e.g., EW) and reach the end user wireless device 606 in a form the device can receive.

Implementations according to other aspects can utilize a variation of the passive heterodyning meta-material antenna 608, in combination with an offset uplink carrier received from the BTS 602, to frequency upshift an uplink transmission from the end user wireless device 606 to a much higher frequency, e.g., millimeter wave, for uplink transmission to the BTS 602. Aspects, as will be described in greater detail in reference to FIG. 7 and elsewhere, can include mixer devices disposed, for example, in the fill region 108. The mixer devices can be in place of, or supplemental to the bandpass filter devices described above. The variation of the passive heterodyning meta-material antenna 608 will therefore be referred to as a "passive mixing heterodyning meta-material antenna." In an implementation, the mixer devices can include an output (RF) port, an intermediate frequency (IF) port fed from one or more of the upper frequency array elements, and a low-band (LO) port fed from one or more of the lower frequency array elements.

In an example operation, the end user wireless device transmits a low-band uplink signal, at a frequency transparent to the exterior wall EW. Assuming the low-band uplink signal is within the lower frequency meta-material band of the passive mixing heterodyning meta-material antenna, the signal's energy is efficiently coupled by the lower frequency elements to the LO ports of the mixer devices. Assuming the received offset uplink carrier signal is within the upper frequency meta-material band of the passive mixing heterodyning meta-material antenna, its energy is efficiently captured by the upper frequency elements, and carried to the IF ports of the mixer devices. The output from the mixers' RF ports can be an up-shifted version of the original uplink transmission from the end user wireless device, now centered at the frequency of the BTS uplink. The RF output is coupled to the upper frequency elements and, being within the upper frequency meta-material band, is efficiently transmitted toward the BTS.

FIG. 7 illustrates one passive mixing heterodyning meta-material antenna communication system 700 according to one implementation, annotated to show example operations in an uplink communication according to various aspects. For brevity, the passive mixing heterodyning meta-material antenna communication system 700 will be alternatively referred to as the "system 700." Referring to FIG. 7, the system 700 can include the same end user wireless device 606, and in addition to the passive mixing heterodyning meta-material antenna 608 (not explicitly visible in FIG. 7), a passive mixing heterodyning meta-material antenna 702. The passive mixing heterodyning meta-material antenna 702 can include a low frequency array of patches 704 (visible in part in FIG. 7), collectively referred to as "low frequency array" 704, facing the exterior wall EW and a high frequency array of patches 706 (visible in part in FIG. 7), collectively referred to as "high frequency array" 706, facing away from the exterior wall. To assist in describing aspects unique to the passive mixing heterodyning meta-material antenna 702, the low frequency array 704 will be assumed as configured and arranged as illustrated for the second conductive patches 110 of the passive heterodyning meta-material antenna 100 described above. Likewise, the high frequency array 706 will be assumed configured and arranged as illustrated for the first conductive patches 102.

Referring to FIG. 7, in one implementation the low frequency array 704 can be supported on a substrate (not explicitly visible in FIG. 7), such as the second substrate 106. The high frequency array 706 can likewise be supported on another substrate (not explicitly visible in FIG. 7), such the first substrate 102. The substrates can be separated by a fill region (not explicitly visible in FIG. 7), such as the fill region 108 of the passive heterodyning meta-material antenna 100. Disposed in the fill region can be an array of mixer devices 708 (visible in part in FIG. 7). In an implementation, bandpass filters (not explicitly visible in FIG. 7), such as the bandpass filters 112, can also be disposed in the fill region. Referring to FIG. 8, the mixer devices 708 can include an output (RF) port 802, an intermediate frequency (IF) port 804, and a low-band (LO) port 806. The LO port 806 can be coupled (by structure not visible in FIGS. 7 and 8) to one or more of the patches among the low frequency array 702. Both the IF port 804 and the RF port 802 can be coupled (by structure not visible in FIGS. 7 and 8) to one or more of the patches among the high frequency array 706.

For purposes of example, it will be assumed that the end user wireless device 606 transmits a device low frequency uplink signal (labeled "ULD") at a frequency, for example, of 600 MHz. It will be understood that 600 MHz was selected as an example in view of the low frequency downlink frequency of 500 MHz, because their 100 MHz spacing may be sufficient to allow the uplink upshifting features of the passive mixing heterodyning meta-material antenna 702 to be included in the passive heterodyning meta-material antenna 100, without substantial likelihood of interference. For purposes of example, 38 GHz will be used for the BTS uplink signal frequency. This is only an example BTS uplink signal frequency, and is not intended as a limitation on the scope of implementations, or as a preferred frequency.

Referring to FIG. 7, in an implementation the system 700 can include a millimeter wave BTS 712, and an offset uplink carrier transmitter 714. The offset uplink carrier transmitter 714 can be configured to transmit an offset uplink carrier (labeled "OUC") with sufficient power and directivity to reach the high frequency array 706. Regarding "sufficient power," persons of ordinary skill, upon reading this disclosure will understand it will be application specific. Such persons will understand that factors can include, but are not necessarily limited to, acceptable error rate of the upshifted uplink signal, received power of the low frequency uplink signal ULD from the end user wireless device 606, efficiency of the mixers 708, and gain of the passive mixing heterodyning meta-material antenna 702. Such persons, having possession of the present disclosure, can ascertain these factors, and can determine the range of power at which OUC must be received to be "sufficient," without undue experimentation.

Referring to FIGS. 7 and 8, energy of the device's low frequency uplink signal ULD at 600 MHz, being within the low frequency meta-material band of the passive mixing heterodyning meta-material antenna 702, will be efficiently captured by the low frequency array 704, and be carried (e.g., through the bi-directional bandpass filters 112) to the LO ports 806. Energy of the offset uplink carrier OUC, since 38 GHz is within the upper frequency meta-material band of the passive mixing heterodyning meta-material antenna 702, will be efficiently captured by the high frequency array 706 and carried to the IF port 804. The mixer output from the RF ports 802 will be the low frequency uplink signal ULD, upshifted to 38 GHz, which is the difference between the frequency of ULD (600 MHz) and the frequency of the offset uplink carrier OUC (38.6 GHz). The upshifted uplink signal (labeled "ULT"), being within the upper frequency meta-material band of the passive mixing heterodyning meta-material antenna 702, will be efficiently radiated or transmitted from the high frequency array 706 to the BTS 712.

Referring to FIGS. 6 and 7, in the above-described downlink operations of system 600, and uplink operations of system 700, the end user wireless device 606 is configured to receive a UHF downlink signal, LDL, and transmit a UHF uplink signal ULD. One or more implementations can also provide, inside the building with the exterior wall EW, a millimeter wave downlink, for example, to a 5G or other millimeter wave downlink end user wireless device. Implementations can also provide access for a millimeter wave uplink, from inside the building, to a remote millimeter wave base station transceiver. For example, the device may lack capability of receiving a UHF downlink or, even if capable, the user or a particular application may require or prefer 5G or other millimeter wave downlink.

One example implementation can include, at a location in the interior of the building that can receive the UHF translated downlink LDL, a passive mixing heterodyning meta-material antenna, such as the example passive mixing heterodyning meta-material antenna 702. For purposes of description, this can be referred to as an "interior passive mixing heterodyning meta-material antenna." For brevity, description herein will alternatively recite the phrase "interior passive mixing heterodyning meta-material antenna" in the following abbreviated form: "interior passive MHMM antenna." It will be understood that "MHMM" is only an arbitrary abbreviation, and does not import into or otherwise add any limitation to this description or its appended claims. In combination with the interior passive MHMM antenna, an implementation can include an interior offset downlink carrier transmitter, configured to generate a millimeter wave signal at a frequency equal to the millimeter wave downlink frequency for the user wireless device, offset by the frequency of the downshifted UHF LDL transmitted through the exterior wall by the low frequency array of the passive heterodyning meta-material antenna 608, as described above. In an example downlink operation of one implementation, the UHF LDL can be received by the low frequency array of the interior passive MHMM antenna, and fed to the LO input ports of the antenna's mixers. The high frequency array of the interior passive MHMM antenna can receive and feed, to the IF ports of the antenna's mixers, the local offset downlink carrier from the interior offset downlink carrier transmitter. The RF port of the mixers can then output and feed to the antenna high frequency array an upshifted millimeter wave downlink signal, for transmission to the user wireless device.

To carry the millimeter wave uplink from the user wireless device to the building exterior, an implementation can include an interior offset uplink carrier transmitter, generating a millimeter wave signal at a frequency offset from the millimeter wave uplink frequency of the user wireless device by a selected UHF uplink center frequency. The selected UHF uplink center frequency can be offset by, for example, approximately 100 MHz or a different amount, from the UHF LDL frequency. In an example uplink operation, the high frequency array of the interior passive MHMM antenna can receive the both millimeter wave uplink from the user wireless device and the interior offset uplink carrier from the interior offset uplink carrier transmitter. The sum of the millimeter wave uplink and the interior offset uplink carrier can create a downshifted UHF version of the uplink signal, at the selected UHF uplink center frequency. The low frequency array of the interior passive MHMM antenna can then transmit this UHF uplink signal through the exterior wall. The low frequency array of the above-described passive mixing heterodyning meta-material antenna 702 can receive that UHF uplink signal and, by operations described in reference to FIG. 7, the antenna 702 can upshift the signal to a millimeter wave uplink signal and transmit that millimeter wave uplink to the millimeter wave BTS.

In another implementation, millimeter wave uplink and downlink access can be provided inside the building with the exterior wall EW by an active, powered, heterodyning frequency upshift/downshift translation unit inside the building. The active, powered, heterodyning frequency upshift/downshift translation unit and can be configured, for example, to receive the UHF LDL signal transmitted through the wall EW, as described in reference to FIG. 6, and transmit a corresponding upshifted millimeter wave local downlink, for reception by a millimeter wave end user device (in place or additional to the user wireless device 606). In an aspect, the active, powered, heterodyning frequency upshift/downshift translation unit can be configured to receive a millimeter wave uplink signal from a millimeter wave uplink/downlink user wireless device, and downshift it to a UHF-centered uplink signal, such as the local uplink ULD described in reference to FIG. 7. The passive mixing heterodyning meta-material antenna 702 can then, by operations also described in reference to FIG. 7, upshift the UHF UDL signal to the millimeter wave uplink ULT, for reception by the millimeter wave BTS 712.

Figure 9:
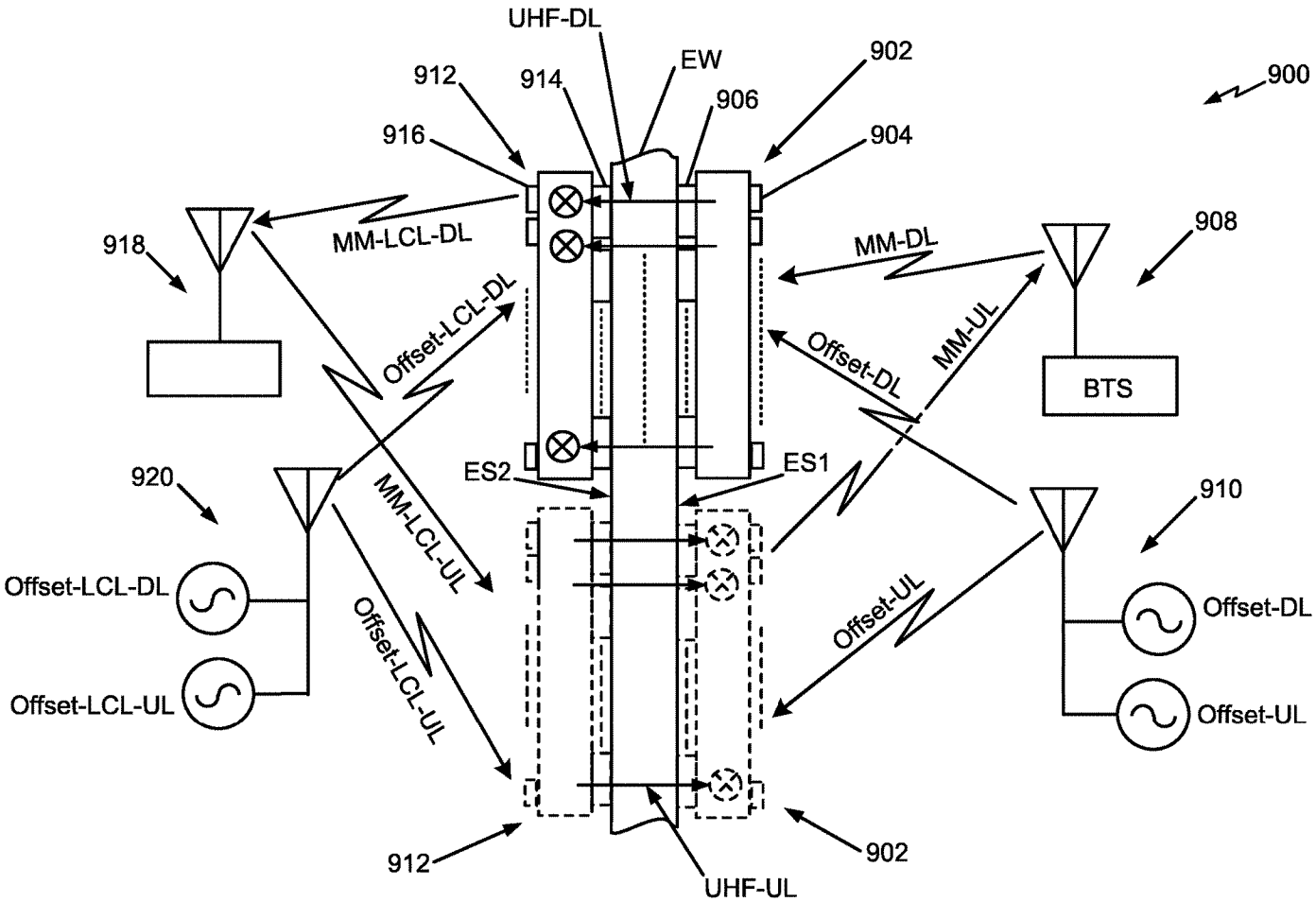
FIG. 9 illustrates one system, overlaid with diagrammed example operations of same, utilizing an interior passive mixing/heterodyning meta-material antenna for millimeter wave uplink and downlink to a building interior, according to various aspects.

FIG. 9 illustrates one system 900, overlaid with diagrammed example operations of same, utilizing an interior passive mixing/heterodyning meta-material antenna for millimeter wave uplink and downlink to a building interior, according to various aspects. Referring to FIG. 9, system 900 can include a first passive MHMM antenna 902 mounted on an exterior surface ES1 of the exterior wall EW. The first passive MHMM antenna 902 can include structure according to the passive heterodyning meta-material antenna referenced as 100 in FIGS. 1A-1D and 608 in FIG. 6, as well as the passive mixing heterodyning meta-material antenna 702. Such structure can include a high frequency array 904 of conducting patches facing away from the exterior surface ES1; a low frequency array 906 facing toward the exterior surface ES1; bi-directional bandpass filters (not visible in FIG. 9) such as the bandpass filters 112; and mixers (visible, but not separately labeled) such as the mixers 710 of the passive mixing heterodyning meta-material antenna 702.

The system 900 can include a BTS 908 remote from the building and, configured, for example, such as the FIG. 7 BTS 712. The BTS 908, for example, can be configured for 5G or other millimeter wave uplink (labeled "MM-UL") and 5G or other millimeter wave downlink (labeled "MM-DL"). The system 900 can include an offset carrier transmitter 910. The offset carrier transmitter 910 can be configured to transmit an offset downlink signal (labeled "Offset-DL"), and an offset uplink signal (labeled "Offset-UL"). The Offset-DL can be in accordance with ODC described in reference to FIG. 6. The Offset-UP can be in accordance with OUC described in reference to FIG. 7

Passive downshifting functionality of the first passive MHMM antenna 902 can be as described in reference to item 608 of FIG. 6, and is represented by the upper instance of item 902, which is in solid lines. Passive mixing upshifting functionality of the first passive MHMM antenna 902 can be as described in reference to item 702 of FIG. 7, and is represented by the lower instance of 902, which is in dotted lines.

The system 900 can include a second passive MHMM antenna 912, which can be structurally identical to the first passive MHMM antenna 902, mounted on an interior surface of ES1 of the exterior wall EW, opposite, or approximately opposite item 902. The second passive MHMM antenna 912 can have a low frequency array 914 facing the interior surface ES2 and a high frequency array 916 facing an interior volume (the region to the left of EW, not separately labeled) of the building. The second passive MHMM antenna 912 can also combine the passive downshifting functionality described in reference to item 608 of FIG. 6, and the passive mixing upshifting functionality described in reference to item 702 of FIG. 7. The passive downshifting functionality is represented by the upper instance of item 912, which is in solid lines, and the passive mixing upshifting functionality is represented by the lower instance of 912, which is in dotted lines.

A millimeter wave (e.g., 5G) uplink/downlink end user wireless device 918, which can be a mobile device, can be located in the interior volume of the building. The millimeter wave uplink/downlink end user wireless device 918 can be configured to directly receive MM-DL and transmit MM-UL, when outside the building.

In an implementation, a local offset carrier transmitter 920 can be located inside the building, and can be configured to transmit a local offset downlink carrier (labeled "Offset-LCL-DL"), and a local offset uplink carrier (labeled "Offset-LCL-UL"), each at a power reaching the high frequency array 916 of the second passive MHMM antenna 912. For purposes of describing example operations, example, it will be assumed the downlink signal MM-DL is centered at 28 GHz, and the uplink signal MM-UL is centered at 38 GHz. Also for purpose of example, Offset-DL will be assumed as 28.5 GHz, and Offset-UL will be assumed as 38.6 GHz. It will be understood that 28 GHz, 28.5 GHz, 38 GHz, and 38.6 GHz are only example downlink and uplink signal frequencies, and example offsets, and are not intended as limitations on the scope of implementations, or as preferred frequencies.

Example Downlink Operations: The MM-DL and Offset-DL can sum at the high frequency array 906 of the first passive MHMM antenna 902. Utilizing operations such as described in reference to the passive heterodyning meta-material antenna 608, a UHF frequency downshifted MM-DL, centered for this example at 600 MHz (the difference between MM-DL and Offset-DL) can be formed, and can pass through the bi-directional bandpass filters (not visible) of the first passive MHMM antenna 902, which energizes the antenna's low frequency array 904. The low frequency array 904 can transmit the 500 MHz downshifted downlink signal, as UHF-DL, through the wall EW. The low frequency array 916 of the second passive MHMM antenna 912 can receive UHF-DL. Since 500 MHz is within the meta-material frequency band of the second passive MHMM antenna 912, its low frequency array 916 can efficiently capture the energy and pass the energy to the LO port of the antenna's mixers (visible but not separately labeled). Offset-LCL-DL, at 28.5 GHz, can be efficiently captured by the high frequency array 914 of the second passive MHMM antenna 912, and is carried to the IF port of the antenna's mixers. The RF ports of the second passive MHMM antenna 912 mixers, in response, can output an upshifted version of UHF-DL, centered at 28 GHz (same as MM-DL), which passes through the bi-directional bandpass filters to the antenna's high frequency array 914. The high frequency array 914 can then transmit the upshifted version of UHF-DL as a millimeter wave local downlink (labeled "MM-LCL-DL"), at 28 GHz, to the millimeter wave uplink-downlink end user wireless device 918.

Example advantages of the system 900, and its operations as described above include the following: if the millimeter wave uplink/downlink end user wireless device 918 is portable, the user can carry it outside of the building without interruption of the downlink, because it can be transparent to the device 918 as to whether it is receiving the millimeter wave local downlink MM-LCL-DL or directly receiving MM-DL.

Example Uplink Operations: MM-LCL-UL (at 38 GHz) and Offset-LCL-UL (at 38.6 GHz) can sum at the high frequency array 914 of the second passive MHMM antenna 912. Utilizing operations described in reference to the FIG. 6 passive heterodyning meta-material antenna 608 in FIG. 6, a UHF frequency downshifted MM-LCL-UL, which for this example is centered at 600 MHz (the difference between MM-LCL-UL and Offset-LCL-UL), can pass through the bi-directional bandpass filters of the second passive MHMM antenna 912 and energize the antenna's low frequency array 916. The low frequency array 916 of the second passive MHMM antenna 912 can transmit the downshifted uplink signal as UHF-UL, through the exterior wall EW.

The low frequency array 906 of the first passive MHMM antenna 902 can efficiently capture UHF-UL and pass the energy to the LO port of the antenna's mixers (visible but not separately labeled). The offset uplink carrier Offset-UL from the offset carrier transmitter 910, at 38.6 GHz, can be efficiently captured by the antenna's high frequency array 904, and carried to the IF port of the antenna's mixers. The RF ports of the mixers of the first passive MHMM antenna 902 can, in response, output an upshifted version of UHF-UL, centered at 38 GHz (same as MM-UL) to the antenna's high frequency array 904. That high frequency array 904 can transmit the 38 GHz upshifted version of UHF-UL as the millimeter wave uplink MM-UL to the BTS 908.

As will be understood by persons of ordinary skill upon reading this disclosure, example advantages of the above-described uplink features of the system 900 include the following: in a 5G or other millimeter wave uplink/downlink end user wireless device 918 is portable, the user can carry it outside of the building, without interruption of the uplink, because it can be transparent to the BTS 908 as to whether it is receiving a direct millimeter wave uplink from the device 918 or a downshifted-upshifted form of that uplink.

Figure 10:
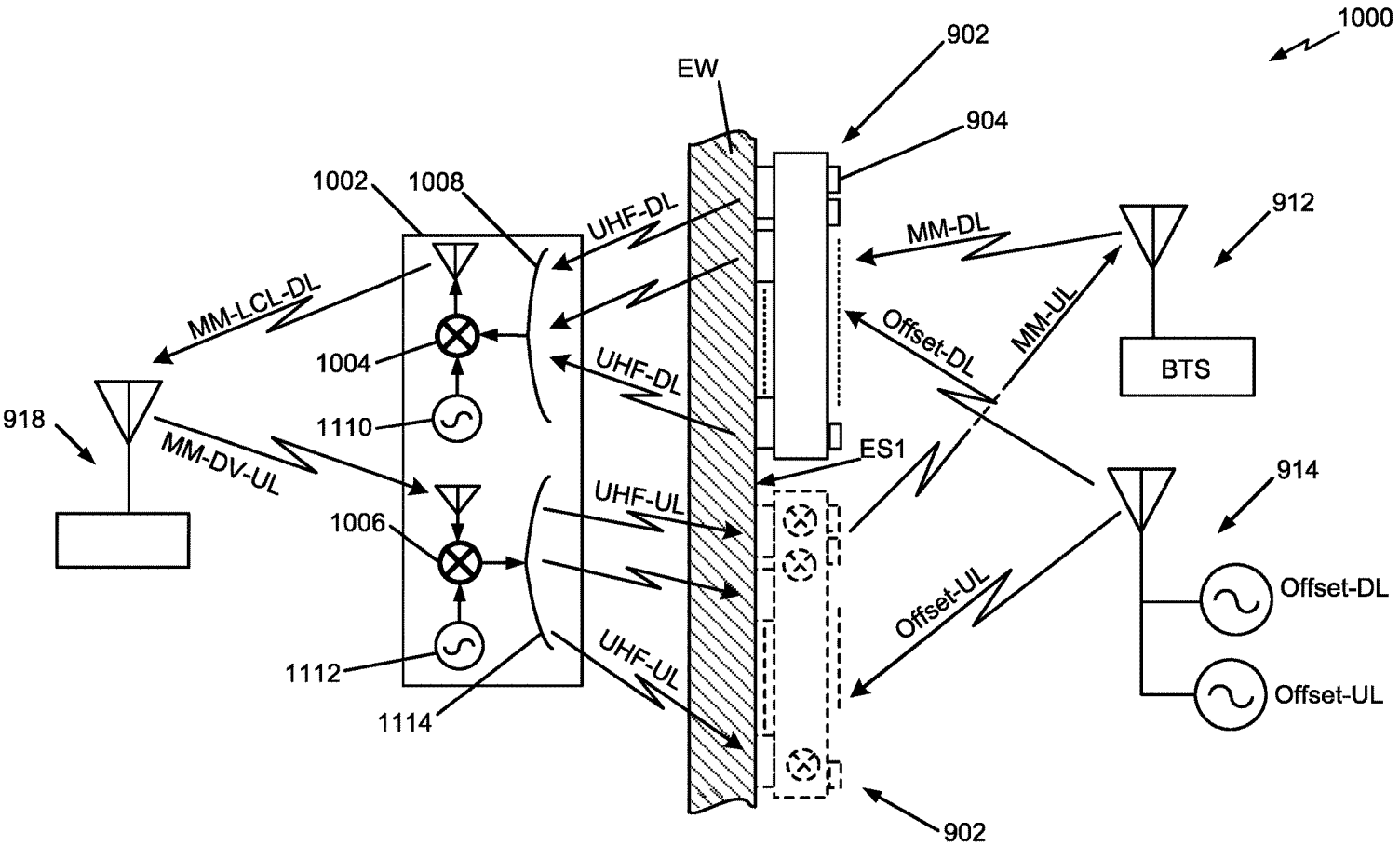
FIG. 10 illustrates one system, overlaid with diagrammed example operations of same, utilizing an exterior passive mixing/heterodyning meta-material antenna and interior active frequency translating unit, for millimeter (mm) wave uplink and downlink to a building interior, according to various aspects.

As briefly described above, one or more implementations can provide millimeter wave uplink and downlink access inside a building using an active, powered, heterodyning frequency upshift/downshift translation unit, also located in the building. FIG. 10 shows one system 1000 illustrating examples of such features. To assist in describing features unique to the system 1000, features common with the system 900 are labeled in like manner. Referring to FIG. 10, system 1000 can include the system 900 first passive MHMM antenna 902, BTS unit 908, and offset carrier transmitter 920. Example operations will be described in reference to the same millimeter wave (e.g., 5G) uplink/downlink end user wireless device 918. The system 1000 can include a powered, heterodyning frequency upshift/downshift translation unit 1002, having a powered translating up-mixer 1004 and a powered translating down-mixer 1006. Example structures and techniques that may be used in implementing the powered heterodyning frequency upshift/downshift translation unit 1002 are described in U.S. patent application Ser. No. 13/722,080, titled "Wireless Radio Extension Using Up-and-Down Conversion," filed Dec. 20, 2012, which is incorporated herein by reference in its entirety.

Referring to FIG. 10, the powered heterodyning frequency upshift/downshift translation unit 1002 can include a UHF reception antenna 1008 coupled to an LO port (visible, but not separately labeled) of the powered translating up-mixer 1004. A local offset downlink carrier oscillator 1010 can generate, and input to an IF port (visible, but not separately labeled) of the powered translating up-mixer 1004, a millimeter wave signal offset in frequency from the downlink carrier frequency by the above-described UHF-DL downlink signal frequency. For purposes of example, the same example frequency of 500 MHz will be assumed for the UHF-DL signal, and the same example frequency of 28 GHz will be assumed for the MM-DL downlink signal from the BTS unit 908, and for reception by the uplink/downlink end user wireless device 918. An RF port (visible, but not separately labeled) of the powered translating up-mixer 1004 can couple to a millimeter wave local transmit antenna (visible, but not separately labeled) of the powered heterodyning frequency upshift/downshift translation unit 1002.

With continuing reference to FIG. 10, implementations can include a local offset uplink carrier oscillator 1012 can generate, and input to an IF port (visible, but not separately labeled) of the powered translating down-mixer 1006, a millimeter wave signal offset in frequency from the uplink carrier frequency by the above-described UHF-UL uplink signal frequency. For purposes of example, the same example frequency of 600 MHz will be assumed for the UHF-UL signal, and the same example frequency of 38 GHz will be assumed for the uplink signal MM-DV-UL from the millimeter wave uplink/downlink end user wireless device 918, and for the BTS 908.

In one implementation, a mixer input port (visible, but not separately labeled) of the powered translating down-mixer 1006 can couple to a millimeter wave local receive antenna (visible, but not separately labeled) of the powered heterodyning frequency upshift/downshift translation unit 1002. In an implementation, the millimeter wave local receive antenna can be, but is not necessarily, the same antenna as the millimeter wave local transmit antenna that receives and transmits the RF output from the powered translating up-mixer 1004. A mixer output port (visible, but not separately labeled) of the powered translating down-mixer 1006 can couple to a UHF transmit antenna 1014. The UHF transmit antenna 1014 can be, but is not necessarily, shared structure with the UHF reception antenna 1008.

Example Downlink Operations: As described above, the MM-DL and Offset-DL can sum at the high frequency array 906 of the passive MHMM antenna 902 and, through passive heterodyning according to disclosed aspects, the low frequency array 904 can transmit the 500 MHz downshifted downlink signal, UHF-DL, through the wall EW. The UHF-DL signal can be received by the UHF reception antenna 1008 and input to the LO port of the powered translating up-mixer 1004. The powered translating up-mixer 1004 can also receives the local offset downlink carrier, at 28.5 GHz, from the local offset downlink carrier oscillator 1010 and, in response, can send an upshifted version of UHF-DL signal, as MM-DV-DL, at 28 GHz, from the millimeter wave local transmit antenna to the millimeter wave uplink/downlink end user wireless device 918.

Example Uplink Operations: The millimeter wave uplink/downlink end user wireless device 918 can transmit a device uplink signal, MM-DV-UL at, for example, 38 GHz. The MM-DV-UL millimeter wave signal can be received by the millimeter wave reception antenna of the powered heterodyning frequency upshift/downshift translation unit 1002 and fed to an input port of the powered translating up-mixer 1006. The powered translating down-mixer 1006 can also receive the local offset uplink carrier, at 38.6 GHz, and in response can output to the UHF transmit antenna 1014 a downshifted uplink signal, UHF-UL, at 600 MHz. The downshifted uplink signal UHF-UL, being at 600 MHz, can pass through the wall EW and be received by the low frequency array of the passive MHMM antenna 902. Then by operations described in reference to FIG. 7, the passive MHMM antenna 902 can upshift the downshifted uplink signal UHF-UL, to 38 GHz, and transmit that signal as MM-UL to the BTS unit 908.

Figure 11:
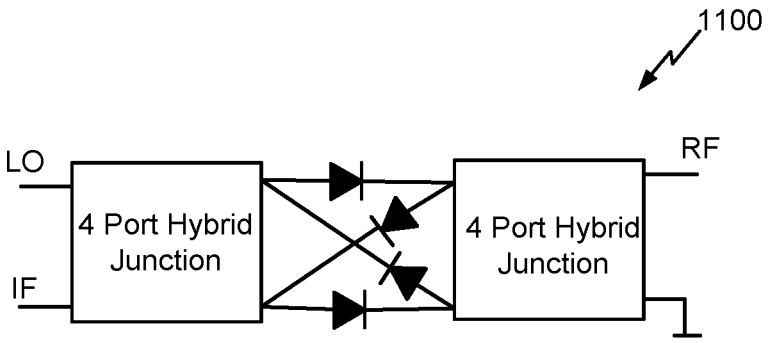
FIG. 11 illustrates one example circuit topology for one mixer device, in a passive mixer heterodyning meta-material antenna according to various aspects.

FIG. 11 illustrates one example circuit topology for one mixer device, in a passive mixer heterodyning meta-material antenna according various aspects.

Figure 12:
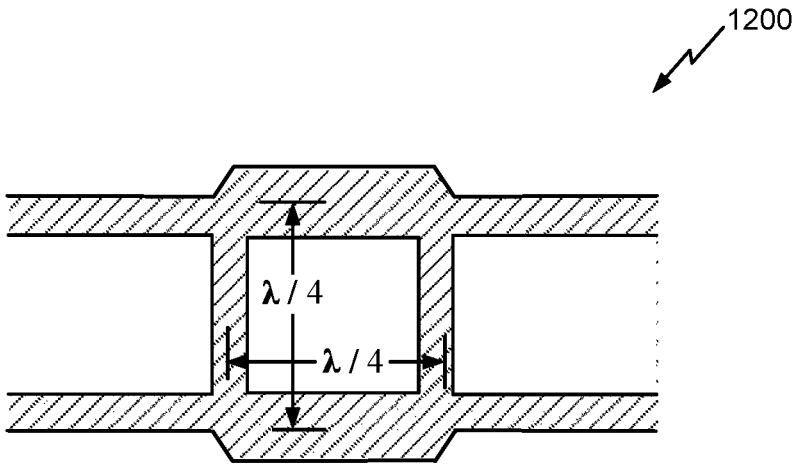
FIG. 12 illustrates one example planar structure for a multiport coupler of a mixer device, in a passive mixer heterodyning meta-material antenna according to various aspects.

FIG. 12 illustrates one example planar structure for a multiport coupler of a mixer device, in a passive mixer heterodyning meta-material antenna according various aspects.

While the foregoing has described what are considered to be the best mode and/or other examples, it is understood that various modifications may be made therein and that the subject matter disclosed herein may be implemented in various forms and examples, and may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," and any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "a" or "an" does not, without further constraints, preclude the existence of additional identical elements in the process, method, article, or apparatus that comprises the element.

The Abstract of the Disclosure is provided to allow the reader to quickly identify the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that any claim requires more features than the claim expressly recites. Rather, as the following claims reflect, inventive subject matter lies in less than all features of a single disclosed example. Thus the following claims are hereby incorporated into the Detailed Description, with each claim standing on its own as a separately claimed subject matter.

What is claimed is:

1. A passive heterodyning meta-material antenna, comprising:

a first face, having a first facing direction, configured to provide a first metamaterial antenna characteristic over a first frequency range;

a second face, having a second facing direction, configured to provide a second meta-material antenna characteristic over a second frequency range;

a bandpass filter, having a first port coupled to the first face and a second port coupled to the second face, configured to have a passband, and to receive signal energy from the first face and deliver a portion of the signal energy within the pass band to the second face, and suppress passing to the second face a portion of the signal energy outside of the passband.

2. The passive heterodyning meta-material antenna of claim 1, further comprising:

an array of first conductive elements, supported on a first substrate, arranged to have the first facing direction according to a first pattern; and an array of second conductive elements, supported on a second substrate to have the second facing direction.

3. The passive heterodyning meta-material antenna of claim 2, wherein:

the first substrate is spaced from the second substrate by a fill region, and the bandpass filter is disposed in the fill region.

4. The passive heterodyning meta-material antenna of claim 3, further comprising an array of bandpass filters, disposed in the fill region, wherein the bandpass filter is one of the array.

5. The passive heterodyning meta-material antenna of claim 4, wherein:

the first port of each of the bandpass filters is coupled to a corresponding one of the first conductive elements, and at least one of the second conductive elements is coupled to the second port of at least two of the bandpass filters.

6. The passive heterodyning meta-material antenna of claim 4, wherein:

each of the bandpass filters includes planar conductors, the bandpass filters and their planar conductors are arranged according to a third pattern, and the first meta-material antenna characteristic is based, at least in part, on a combination of the first pattern and the third pattern.

7. The passive heterodyning meta-material antenna of claim 6, wherein the second meta-material antenna characteristic is based, at least in part, on a combination of the second pattern and the third pattern.

8. The passive heterodyning meta-material antenna of claim 4, wherein the bandpass filters are bi-directional.

9. The passive heterodyning meta-material antenna of claim 8, further comprising a mixer, disposed in the fill gap, the mixer having a low frequency (LO) port, an intermediate frequency (IF) port and a radio frequency (RF) port, wherein:

the LO port is coupled, to signals within the passband, to at least one of the second conductive elements, and the IF port and the RF port are coupled to at least one of the first conductive elements.

10. A method for wireless communication, comprising:

receiving at a first face of a meta-material antenna a first wireless signal, the first wireless signal being centered at a first frequency;

concurrent with receiving the first wireless signal, receiving at the first face of the meta-material antenna a second wireless signal, the second wireless signal being an un-modulated carrier wave, having a second frequency, the second frequency being spaced in frequency from the first frequency, and providing a summing of the first wireless signal and the second wireless signal at the first face to form a sum of signals, the sum of signals including a downshifted version of the first wireless signal, centered at the difference between the first frequency and the second frequency;

passing the downshifted version of the first wireless signal to a second face of the meta-material antenna; and transmitting the downshifted version of the first wireless signal from the second face of the meta-material antenna.

11. The method of claim 10, wherein passing the downshifted version of the first wireless signal to the second face of the meta-material antenna includes passing the downshifted version through a bandpass filter, and filtering from the sum signals frequencies corresponding to a sum of the first frequency and second frequency.

12. The method of claim 10, further comprising:

transmitting the downshifted version of the first wireless signal through a building structure;

receiving the downshifted version of the first wireless signal, after transmission through the building structure;

frequency upshifting the received downshifted version of the first wireless signal, after transmission through the building structure, to an upshifted signal; and transmitting the upshifted signal to an end user device.

13. The method of claim 12, wherein:

the first wireless signal is a millimeter wave signal, and the downshifted version of the first wireless signal is an ultra-high frequency (UHF) signal.

14. The method of claim 13, wherein frequency upshifting the received downshifted version of the first wireless signal, after transmission through the building structure, to the upshifted signal comprises:

receiving the downshifted version of the first wireless signal at a first face of an other meta-material antenna;

receiving, at a second face of the other meta-material antenna, an offset downlink carrier signal, the offset downlink carrier signal being at frequency higher than UHF; and heterodyning, by passive mixers disposed between the first face and the second face of the other meta-material antenna, the received downshifted version of the first wireless signal with the offset downlink carrier signal and generating, as a result, the upshifted signal, wherein transmitting upshifted signal includes radiating the generated frequency upshifted signal from the second face of the other meta-material antenna.

15. A method for wireless communication, comprising:

receiving at a first face of a meta-material antenna a first wireless signal, the first wireless signal being centered at a first frequency;

receiving, at a second face of the meta-material antenna, a second wireless signal, the second wireless signal being centered at a second frequency, the second frequency being higher than the first frequency;

heterodyning, by passive mixers disposed between the first face and the second face, the received first wireless signal with the received second wireless signal and generating, as a result, a frequency shifted signal; and radiating the frequency shifted signal from the second face of the meta-material antenna.

16. The method of claim 15, wherein:

receiving the first wireless signal includes receiving the first wireless signal at an array of first conductive elements disposed parallel the first face, and receiving the second wireless signal includes receiving the second wireless signal at an array of second conductive elements disposed parallel the second face.

17. The method of claim 15, wherein:

the second wireless signal is received from a pointing direction, and radiating the frequency shifted signal is configured to radiate the frequency shifted signal toward the pointing direction.

18. The method of claim 15, wherein receiving the first wireless signal includes receiving the first wireless signal through a wall of a building.

19. The method of claim 15, wherein the frequency shifted signal is radiated at a third frequency, wherein the third frequency is the difference between the first frequency and the second frequency.

20. The method of claim 15, wherein the second wireless signal is an un-modulated carrier wave.

* * * * *